United States Patent [19]

Ropella

[11] 3,994,110

[45] Nov. 30, 1976

[54] THREE HOUR FIRE RESISTANT DOOR, PANEL OR BUILDING ELEMENT, AND METHOD OF MANUFACTURING THE SAME

[75] Inventor: Leonard A. Ropella, Madison, Wis.

[73] Assignee: Champion International Corporation, Stamford, Conn.

[22] Filed: Apr. 10, 1975

[21] Appl. No.: 566,958

[52] U.S. Cl. ..... 52/615; 52/457; 428/141; 428/443

[51] Int. Cl.[2] ..... E04B 1/94; B27K 3/18

[58] Field of Search ..... 52/404, 232, 457, 456, 52/615, 612, 619; 428/443, 141, 920, 921

[56] References Cited

UNITED STATES PATENTS

| | | | |
|---|---|---|---|
| 1,766,606 | 6/1930 | Coolidge | 428/921 |
| 2,045,099 | 6/1936 | Pond | 428/443 |
| 2,593,050 | 4/1952 | Paul et al. | 52/232 |
| 2,787,345 | 4/1957 | Soubier et al. | 52/612 |
| 3,196,494 | 7/1965 | Hartman et al. | 428/443 |
| 3,254,592 | 6/1966 | Chase | 52/615 |
| 3,488,209 | 1/1970 | Ayers et al. | 428/443 |

*Primary Examiner*—James L. Ridgill, Jr.
*Attorney, Agent, or Firm*—Evelyn M. Sommer; Anthony J. Casella

[57] ABSTRACT

A highly resistant fire door, panel or building element comprising in combination a calcium silicate-asbestos fiber core, framed by stiles and rails, two face veneers on the front and rear side of said core and cross bands intermediate said core and said veneers.

7 Claims, 6 Drawing Figures

THREE HOUR FIRE RESISTANT DOOR, PANEL OR BUILDING ELEMENT, AND METHOD OF MANUFACTURING THE SAME

The present invention is broadly concerned with building construction units and more particularly relates to an improved fire resistant composite door, panel or similar structure. Still more particularly, the present invention provides a structural unit such as a door or panel which is substantially fireproof, being highly resistant to the destructive action of fire and of extremely high temperatures for a period of at least three hours. The door or panel or equivalent structural unit of the present invention is composed of a plurality of different materials, each of which functions to raise the fire resistant characteristics of the unit as a whole to an extremely high level.

The cement asbestos board used herein preferably is composed of long fiber asbestos and Portland cement pressed to uniform density and thickness and having a specific gravity of approximately 1.00 to 1.25.

The invention is also concerned with the method of manufacture of such a three hour fire resistant door whereby fire hazards are substantially eliminated.

It is an object of this invention to provide an improved fire resistant door, panel or similar structure, i.e., capable of withstanding fire and high temperatures for at least three hours.

Another object of the present invention is to provide a composite door or structural unit of the type indicated which is highly resistant to leakage or the passage therethrough of hot gases, hot air, smoke or other vapors and which will not warp or bend when subjected to extremely high heat which is concentrated on one side of the door or panel.

Other objects of the present invention are to provide a high quality fireproof unit which is composed of materials which are light in weight and yet highly resistant to the transmission of heat therethrough.

In essence, the door or panel of the present invention comprises in combination a core containing calcium silicate, and asbestos fibers and suitable stiles, rails, cross bands, glue sheets and veneer facings.

A specific feature is the use of cement asbestos board cross bands intermediate the core and the veneer faces.

The composite door or panel structure of the present invention is of such a nature that it will meet the Fire Underwriters Laboratory tests UL 10(*b*) and ASTM E 152–66 for Fire Tests of Door Assemblies. For example, one test requires the door to pass the code requirement for a 3-hour fire door test. In this test, the door must be capable of withstanding, for 3 hours, flames which cause a buildup of the temperature to 1925° F. on one face of the door. The temperature rise on the opposite face of the door during the first one-half hour must not exceed 250° F. above ambient temperature. At the end of this fire exposure test, the door must withstand the impact of a water hose stream at 45 lbs. pressure, when the stream is played on the door from a distance of 20 feet for 3 seconds for every sq. ft. of exposed area. As pointed out heretofore, the door or structure of the present invention is highly resistant to the leakage or transmission of high temperature heat which might ignite any flammable materials which are located on the cold side of the structure.

One embodiment of a structure of the present invention may be readily appreciated by reference to the figures illustrating a 3-hour wood faced fire door.

FIG. 5 is a side view in elevation, while

One set of satisfactory dimensions are given in the figures.

Core 1 of the door contains fireproof and non-burning inorganic materials which have excellent heat insulating properties. A particularly basic desirable material for the core is "Weldrok" which is sold by Champion International Corporation. In essence, the core materials of Weldrok consist essentially of an incombustible mineral material of complex metal silicates with asbestos fiber binder. The density of the core material ranges from about 18 to 24 lbs./ft.$^3$, the weight/sq. ft. is about 4 lbs. Weldrok is warp free and stable and possesses a U factor of approximately 0.35 B.T.U./hr./sq.ft./°F. A desirable density in connection with the invention for such material is in the range of 20 to 24 lbs./cu.ft. and a particularly preferred silicate material for the core is calcium silicate subhydrate which has been rendered porous by manufacturing steps.

Some typical Weldrok formulations are listed in the following Table I.

TABLE I*

| | Wt. % | |
|---|---|---|
| | Specific | Range |
| Calcium Silicate | 85.0 | 70.0 – 90.0 |
| Asbestos Fibers | 10.0 | 5.0 – 20.0 |
| Moisture | 5.0 | 2.0 – 15.0 |

*A relatively small amount of diatomite may also be present.

Figure 1:
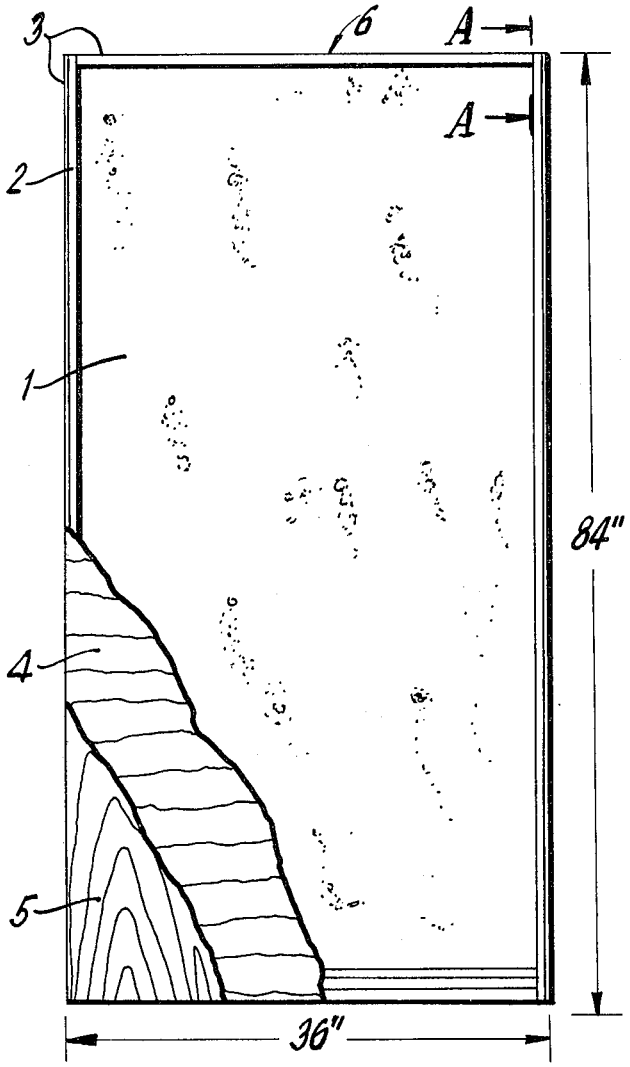
FIG. 1 is a plan view of the door with the facing plies thereof broken away in order to show one form of core construction.
Figure 2:
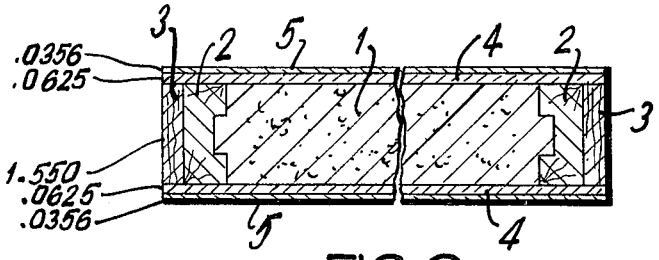
FIG. 2 is a fragmentary cross-sectional elevation view through the core and door. The door comprises in essence a fire resistant core, stile, rails, cement asbestos board cross bands and veneer facings.
Figure 3:
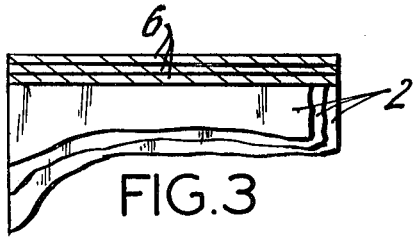
FIG. 3 is a partial section along line A—A of FIG. 1 showing a plywood stile and rail.

The structural frame comprising stiles 2 and rails 6 is made of fire-resistant treated soft maple. Preferred stiles and rails are of a 3 or 5 plywood structure. (See FIG. 3). Treating of the wood material is carried out by a vacuum pressure cell process. A vacuum of about 22 in. of mercury is produced and the treatment is carried out in an autoclave. A temperature between 100° F. and 200° F. such as 150° F. at pressure between 125 psi and 225 psi such as about 175 psi is maintained for between 15 and 20 hours, for instance for about 18 hours. The treatment solution consists of a combination of monoammonium phosphate, borax and ammonium sulfate.

Fire retardant elements 3 are desirable and are positioned along the stiles 2. Elements 3 comprise ¼ inch fire retardant treated soft maple elements, the treatment being as described above i.e., by the vacuum pressure cell process.

The cement asbestos board cross bands 4 contribute greatly to the basic fireproofing composition and nature of the door of the present invention.

Cement asbestos board is composed of long fiber asbestos and Portland cement pressed to a uniform thickness and density. The density can be in the range of 1.00 to 1.25 specific gravity. The board is non-combustible. The high density serves to retard destruction of the unit as for example established by resistance to the effect of the hose stream during the test exposure.

The faces 5 of the door are composed of lignocellular material, preferably veneer, and are laminated to the cross bands 4 preferably with a phenolic impregnated adhesive. A preferred type of adhesive is precatalyzed phenolic powdered resin such as the resin HP-401D, made by the Borden Chemical Company. Another satisfactory adhesive is "Tego" sold by Rohm and Haas. Tego is a B stage phenolic impregnated adhesive sheet which will cure under heat.

The dimensions of the panel or door may be varied appreciably depending upon its ultimate use. These dimensions are interrelated and depend upon the size and unit being fabricated. A particular satisfactory unit has a core having a thickness of approximately 1.550 inches. Under these conditions, the rails would approximate ¾ × 1.550 inches and the thickness of the cross band 4 would approximate 0.0625 inch. A typical instance of satisfactory dimensions has been given in the figures.

Figure 4:
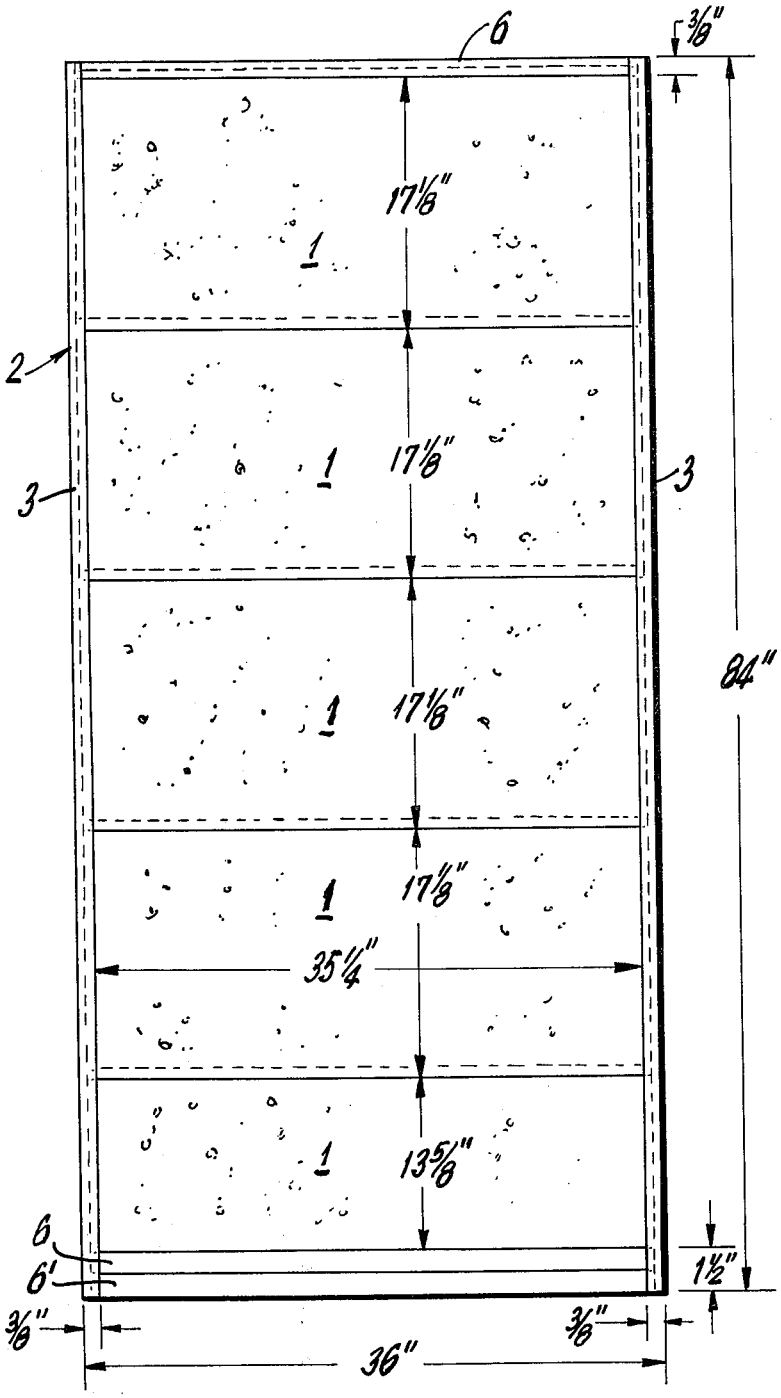
FIG. 4 shows in some detail a sectional core with tongue and grooved at the joints.
Figure 5:
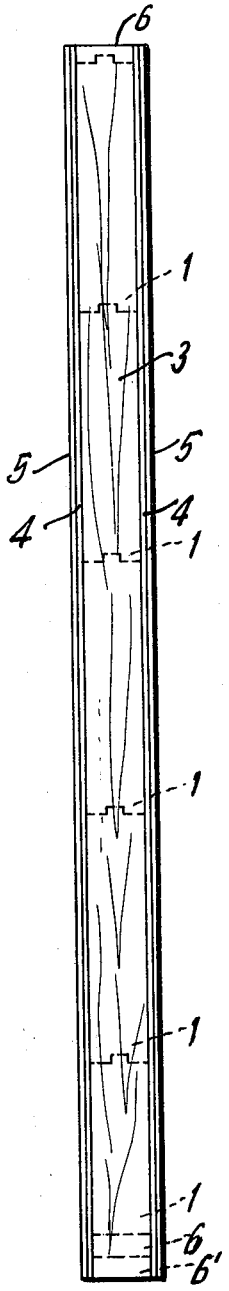
Figure 6:
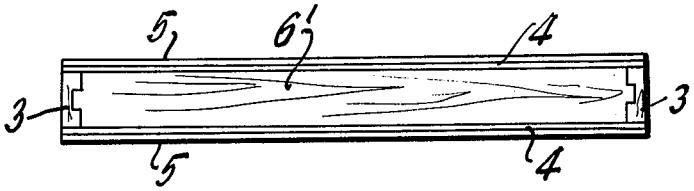
FIG. 6 is a bottom view.

FIGS. 4, 5 and 6 illustrate a similar door with modifications. Similar parts are similarly designated. FIG. 4 shows the use of a double bottom rail 6 and 6'. The bottom rail width facilitates the installation of the doors. This allows a cutting of the door for length without destroying the fire resistance integrity.

The present invention may be more fully understood by the following Example illustrating one embodiment of the same.

EXAMPLE

Step 1

Two ⅛ inch cement asbestos board crossbanding sheets were sized on both sides with a phenolic sizing solution. The sizing used is a low molecular weight phenolformaldehyde condensation product. The low molecular weight and low viscosity allows the resin to penetrate the cement asbestos board and to improve the gluability of the material Step 2

Birch faces of 1/28 inch thickness were glued to the crossbanding sheets. A Tego film was used as the adhesive. The two-ply panels were hot pressed at a temperature of about 300° F. at a pressure of about 250 psi for a period of about 6 minutes.

Step 3

The core was composed of Weldrok having a thickness of about 1.550 and consisted of 5 Weldrok pieces which were joined by tongue and groove means. Stiles and rails were glued flush.

Step 4

The two-ply skins were then pressed to the core using a phenolresorcinol adhesive. Other types of fire resistant adhesives, such as resorcinal adhesives may also be used. The pressing was carried out at 75° F. at a pressure of 200 psi for a time period of about 4 hours.

Step 5

The door was then net sized. The stiles and top rail were about ⅜ inch in thickness. The bottom rail had a thickness of about 1½ inches.

The door was then fire tested using the 3 hour test as described in ASTM (152–66).

The results of the testing are hereinafter set out:

| Time | Comments |
|---|---|
| 0.0 Minutes | Test Start. |
| 1.0–10.0 | Hot face ignition—loud blows from cement asbestos board pulling away from Weldrok. |
| 30.0 | Cold face temperature—170° F. average, ambient 80° F. Cold face is bowing inward. |
| 34.0 | Discoloration along lockset and center hinge. |
| 45.0 | All 4 Weldrok joints on hot face visible. |
| | Warp measurements: |
| | Top lockside—15/16"<br>Bottom lockside—½"<br>Top hingeside—½"<br>Bottom hingeside—⅜" |
| 53.0 | Getting heavy discoloration along stiles. |
| 1.0 Hour | Cold face temperature—304° F. average, ambient 100° F. —thermocouples taken off at this point. |
| 1.20 | Beginning to get white charring on bottom rail, 12" from lock end. |
| 1.30 | One-half test duration, warp measurements: |
| | Top lockside—1⅜"<br>Bottom lockside—⅜"<br>Top hingeside—⅝"<br>Bottom hingeside—½" |
| 1.32 | All Weldrok joints visible on cold side. Cold face is moderately discolored. |
| 2.30 | Heavy discoloration of cold face. White charring of cement asbestos board on all four sides but no burn through. Door looks excellent. |
| 2.58 | Final warp measurements: |
| | Top lockside—1¾"<br>Bottom lockside—½"<br>Top hingeside—¾"<br>Bottom hingeside—½" |
| 3.0 Hours | End of test. |
| | Hose stream followed—passed. |

The door performed superbly for the entire three-hour exposure. Warpage was surprisingly minimum, never exceeding 1¾ inches.

At the completion of the three-hour exposure, the assembly was subjected to the standard Underwriters' Laboratories hose stream test, 45 psi for 63 seconds. The door remained firm and intact.

What is claimed:

1. A three-hour fire resistant door comprising in combination:

a generally rectangular, planar calcium silicate-asbestos fiber core having peripheral edges and opposed faces;

stiles and rails framing the edges of said core, said stiles and rails being of 3 to 5 plywood contruction and being monoammonium phosphate borax, ammonium sulphate pressure treated elements;

cement asbestos board cross bands disposed on opposite faces of said core and in intimate contact therewith; and two face veneers disposed on the exposed faces of said cement asbestos board cross bands.

2. Process for the manufacture of a three-hour fire resistant door comprising the steps of:

preparing a core consisting essentially of calcium silicate and asbestos fiber, said core being generally rectangular and having a peripheral edge and opposed face surfaces;

framing said core with stiles and rails of three to five plywood structure;

affixing two cement asbestos board cross bands band sheets to two veneer sheets to form two two-ply skins; and affixing said two two-ply skins respectively to the opposed face surfaces of the core such that the cement asbestos board cross bands are intermediate said core and said veneer sheets.

3. Process as defined by claim 2 wherein said core consists essentially of about 70% by weight to 90% by weight of calcium silicate and 5% by weight to 20% by weight of asbestos fibers.

4. Process as defined by claim 2 wherein said stiles and rails are monoammonium phosphate, borax, ammonium sulfate pressure treated elements.

5. Process as defined by claim 4 wherein said pressure treatment is conducted at a temperature in the range of about 100° to 200° F., at a pressure in the range of about 125 psi to 225 psi for a time period of about 15 to 21 hours.

6. Process as defined by claim 2 wherein said cement asbestos board cross bands are of a density in the range of about 85 lbs. to 105 lbs./Ft.$^3$ and of a thickness in the range of about 1/16 to about one-fourth inch.

7. Process as defined by claim 6 wherein said cross bands are affixed to said veneer faces at a temperature in the range of about 275° to 300° F., at a pressure in the range of about 100 to 250 psi and for a time period in the range of about 4 to 8 minutes.

* * * * *